US011773035B2

(12) United States Patent
Carter

(10) Patent No.: US 11,773,035 B2
(45) Date of Patent: Oct. 3, 2023

(54) ENERGETIC LADEN FIBER FOR EXPLOSIVE CORD FILL

(71) Applicant: GOODRICH CORPORATION, Charlotte, NC (US)

(72) Inventor: Joshua David Carter, Fairfield, CA (US)

(73) Assignee: Goodrich Corporation, Charlotte, NC (US)

( * ) Notice: Subject to any disclaimer, the term of this patent is extended or adjusted under 35 U.S.C. 154(b) by 1174 days.

(21) Appl. No.: 16/415,804

(22) Filed: May 17, 2019

(65) Prior Publication Data

US 2020/0361833 A1 Nov. 19, 2020

(51) Int. Cl.
*C06C 5/04* (2006.01)
*C06B 25/00* (2006.01)

(52) U.S. Cl.
CPC ..... *C06C 5/04* (2013.01); *C06B 25/00* (2013.01)

(58) Field of Classification Search
None
See application file for complete search history.

(56) References Cited

U.S. PATENT DOCUMENTS 3,621,558 A 11/1971 Welsh et al.
4,083,305 A * 4/1978 Garrison ..... C06C 5/04 102/275.8
5,322,018 A 6/1994 Hadden et al.
6,647,887 B2 11/2003 Smith et al.
2017/0320788 A1* 11/2017 Lambert ..... F42C 19/02

* cited by examiner

*Primary Examiner* — Aileen B Felton
(74) *Attorney, Agent, or Firm* — Snell & Wilmer L.L.P.

(57) ABSTRACT

An explosive cord is disclosed. In various embodiments, the explosive cord includes a tube having a tube inner surface and a tube outer surface, the tube inner surface defining a hollow interior that extends along a length of the tube; a carrier fiber disposed within the hollow interior of the tube, the carrier fiber having a carrier fiber exposed surface area; and a reactive material disposed on the carrier fiber exposed surface area.

14 Claims, 2 Drawing Sheets

ENERGETIC LADEN FIBER FOR EXPLOSIVE CORD FILL

FIELD

The present disclosure relates generally to explosive cords and, more particularly, to explosive cords having energetic laden carrier fibers.

BACKGROUND

Explosive cords are employed in aerospace and other applications for transferring an explosive signal from one location to another. For example, explosive cords may be employed in providing precise delays or timing relationships between different energetic reactions that are initiated by the explosive signal. The manufacture of explosive cords typically involves extruding a hollow tube while an inner surface of the hollow tube is simultaneously coated or otherwise supplied with an energetic material or explosive powder.

SUMMARY

An explosive cord is disclosed. In various embodiments, the explosive cord includes a tube having a tube inner surface and a tube outer surface, the tube inner surface defining a hollow interior that extends along a length of the tube; a carrier fiber disposed within the hollow interior of the tube, the carrier fiber having a carrier fiber exposed surface area; and a reactive material disposed on the carrier fiber exposed surface area.

In various embodiments, a hollow space extends along the length of the tube between the tube inner surface and a carrier fiber outer surface. In various embodiments, the reactive material comprises an organic explosive component. In various embodiments, the reactive material comprises between seventy percent and one-hundred percent by weight of the organic explosive component. In various embodiments, the reactive material includes a metallic component. In various embodiments, the reactive material comprises up to thirty percent by weight of the metallic component. In various embodiments, an outer shell is disposed about the tube outer surface.

In various embodiments, the carrier fiber comprises a polymeric material. In various embodiments, the polymeric material comprises a poly ethylene chlorotrifluoroethylene component. In various embodiments, the reactive material is adhered to the carrier fiber exposed surface area by a binder. In various embodiments, the reactive material includes particles of an organic explosive disposed on the carrier fiber exposed surface area. In various embodiments, the particles of the organic explosive have a size between about twelve microns and about thirty microns. In various embodiments, the carrier fiber comprises a porous material. In various embodiments, the reactive material is disposed within the carrier fiber using a solvent laden with the reactive material. In various embodiments, the carrier fiber is a string or a yarn.

A method of constructing an explosive cord is disclosed. In various embodiments, the method includes the steps of providing a tube having a tube inner surface and a tube outer surface, the tube inner surface defining a hollow interior that extends along a length of the tube; and inserting a carrier fiber within the hollow interior of the tube, the carrier fiber having a carrier fiber exposed surface area and a reactive material disposed on the carrier fiber exposed surface area.

In various embodiments, the carrier fiber comprises a synthetic material or a natural material. In various embodiments, the reactive material comprises an organic explosive component adhered to the carrier fiber exposed surface area. In various embodiments, the reactive material comprises between seventy percent and one-hundred percent by weight of the organic explosive component. In various embodiments, the reactive material comprises up to thirty percent by weight of a metallic component.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1:
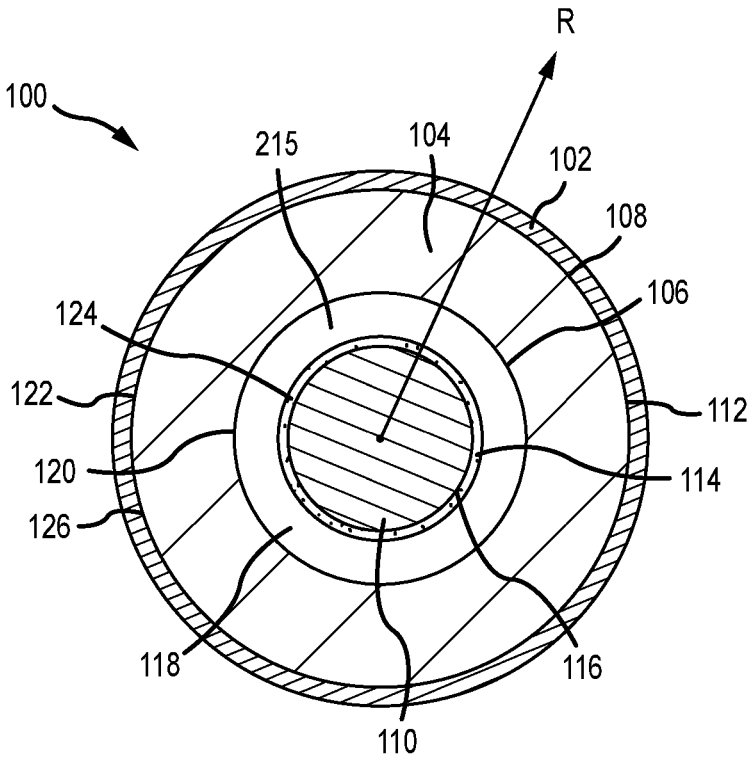
FIG. 1 is a schematic cross sectional view of an explosive cord, in accordance with various embodiments.

Referring now to the drawings, FIG. 1 schematically illustrates a cross section of an explosive cord 100. In various embodiments, the explosive cord 100 may include an outer shell 102, a tube 104 disposed radially inward of the outer shell 102 and defining a radially inner surface 106 and a radially outer surface 108, the radially inner surface defining a hollow interior that extends along a length of the tube 104. A carrier fiber 110 is disposed within the hollow interior and along the length of the tube 104, radially inward of the radially inner surface 106. In various embodiments, the radially outer surface 108 of the tube 104 may be circumferentially coupled to a radially inner surface 112 of the outer shell 102, which may define the radially outwardmost component of the explosive cord 100. In various embodiments, however, the explosive cord 100 may not include the outer shell 102, leaving the radially outer surface 108 of the tube 104 as the radially outward-most component of the explosive cord 100. In various embodiments, a reactive material 114 may be disposed on a radially outer surface 116 of the carrier fiber 110. In various embodiments, the carrier fiber 110 may comprise a porous fiber or a fiber having a radially outer surface that is dimpled. To account for such or similar embodiments, including embodiments where the carrier fiber 110 is substantially smooth along the radially outer surface, the reactive material 114 may be considered as being disposed on a carrier fiber exposed surface area, which takes account of all such embodiments—e.g., where the carrier fiber 110 has a smooth surface, a dimpled surface or pores extending within or through the carrier fiber, the latter embodiments permitting reactive material to be deposited not only on an outer surface of the carrier fiber, but on the surfaces of pores extending within or through the carrier fiber 110. Additionally, in various embodiments, the carrier fiber 110 may act as a scaffold, where the reactive material 114 is carried on the various surface configurations above described, or resides within the composition of the carrier fiber 110 itself. In various embodiments, a hollow space 118 may be defined between the radially outer surface 116 of the carrier fiber 110, or by the reactive material 114 disposed on the radially outer surface 116, and the radially inner surface 106 of the tube 104.

While the explosive cord 100 is described above and elsewhere herein in terms of a radial cross sectional geometry, the disclosure contemplates other cross sectional geometries, such as, for example, triangular, square or N-polygonal cross sectional geometries, where N represents the number of sides of, for example, an inner surface of a tube and an outer surface of a carrier fiber disposed longitudinally within the tube. Accordingly, in various embodiments, the radially inner surface 106 and the radially outer surface 108 of the tube 104 may be defined more broadly as a tube inner surface 120 and a tube outer surface 122, respectively. Similarly, the radially outer surface 116 of the carrier fiber 110 may be defined more broadly as a carrier fiber outer surface 124, subject to the qualification described above where reactive material may be deposited on a carrier fiber exposed surface area, which may include both the carrier fiber outer surface and the surfaces of any pores extending through or within the carrier fiber. Similarly, the radially inner surface 112 of the outer shell 102 may be defined more broadly as a shell inner surface 126. Unless otherwise specified, the description that follows will refer to the more broad terms described above.

In various embodiments, the outer shell 102, if provided, may comprise any material suitable to provide abrasion protection and tensile strength along the length of the explosive cord 100, such as, for example, steel (including stainless steel) or any other suitable material, either metallic or non-metallic. In various embodiments, the tube 104 may comprise a polymeric material. For example, the tube 104 may comprise a fluoropolymer including polytetrafluoroethylene ("PTFE") or a copolymer of ethylene and chlorotrifluoroethylene (e.g., poly ethylene chlorotrifluoroethylene or a poly ethylene chlorotrifluoroethylene component) available commercially under the tradename HALAR® from Solvay (www.solvay.com). In various embodiments, the tube 104 may comprise other suitable materials, such as, for example, polypropylene, polyethylene, polyolefin, polyurethane or other like materials. As described above, the tube 104 may have any cross-sectional shape, such as, for example, circular, square, rectangular, triangular or N-polygonal.

In various embodiments, the reactive material 114 may comprise a pulverulent or similar material that is able to propagate a pressure wave and hot gas through a length of the explosive cord 100, causing a thin layer detonation through the hollow space 118 of the explosive cord 100. For example, the reactive material 114 may comprise an organic explosive or an organic explosive component. In various embodiments, the reactive material 114 may comprise a mixture of organic explosives or organic explosive components, such as, for example, hexanitrostilbene (HNS), pentaethrythritol tetranitrate (PETN), Tetryl, HMX, RDX, CL-20, TNT or the like, and a metallic material (or a metallic component), such as, for example, aluminum, titanium, boron, steel, zirconium, iron or the like. In various embodiments, the metallic material may comprise particles that are, for example, spherical, flake-shaped, acicular, needle-shaped, or any other suitable shape. The particles of organic explosive in the reactive material 114 may be between about twelve microns (12μ) and about thirty microns (30μ) in size along a characteristic dimension (e.g., along a diameter for particles having a substantially spherical shape). As used in this context, the term "about" refers to plus or minus microns (±2μ) For example, the reactive material 114 may comprise between seventy percent (70%) and one-hundred percent (100%) by weight of the organic explosive and between zero percent (0%) and thirty percent (30%) by weight of the metallic material. In various embodiments, the reactive material 114 comprises a mixture of about ninety-one percent (91%) by weight of the organic explosive and about nine percent (9%) by weight of the metallic material. As used in this context, the term "about" refers to plus or minus two percent (±2%) by weight. In various embodiments, a nominal loading of about 21.6 mg/meter of the organic explosive and about 2.2 mg/meter of the metallic material is used in the explosive cord 100. As used in this context, the term "about" refers to plus or minus 2 mg/meter. In various embodiments, an adhesive resin may be added to the reactive material 114 to aid in coupling the reactive material 114 to the carrier fiber 110.

In various embodiments, the carrier fiber 110 may comprise a length of porous material, either synthetic or natural, having a characteristic cross sectional dimension less than a characteristic cross section dimension defined by the tube inner surface 120, thereby permitting the carrier fiber 110 to be threaded through or otherwise installed in the tube 104. In various embodiments, for example, the carrier fiber 110 may comprise any of the materials described above used to construct the tube 104. Additionally, in various embodiments, the carrier fiber may comprise a natural material such as, for example, a length of yarn or string. In various embodiments, the carrier fiber 110 may be saturated or coated with the reactive material 114 prior to being threaded through or otherwise installed in the tube 104. For example, in various embodiments, the reactive material 114 may be deposited on or within the carrier fiber 110 by soaking the carrier fiber with a solvent laden with the reactive material 114. In various embodiments, the reactive material 114 may be deposited on the carrier fiber outer surface 124 and adhered to the outer surface using an adhesive, such as, for example, a glue or binder. Further, in various embodiments, the carrier fiber 110 may be extruded and coated with the reactive material 114 prior to the extrusion reaching a final, cooled temperature.

Figure 2:
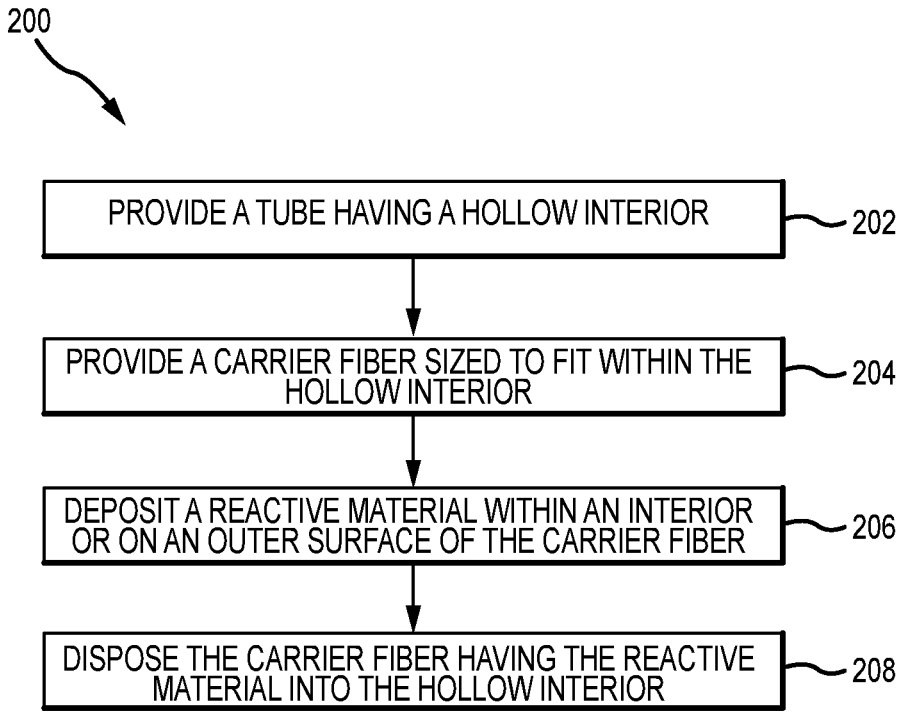
FIG. 2 is a flowchart that describes a method of constructing an explosive cord, in accordance with various embodiments.

Referring now to FIG. 2, a method 200 of constructing an explosive cord, such as, for example, the explosive cord 100 described above with reference to FIG. 1 is described as including one or more of the following steps. In various embodiments, a first step 202 may include fabricating or otherwise supplying a tube having a hollow interior, such as, for example, the tube 104 described above with reference to FIG. 1. For example, a polymeric material comprising a fluoropolymer, such as, for example, poly ethylene chlorotrifluoroethylene, may be processed and extruded into the tube having a desired cross sectional shape. A second step 204 may include fabricating or otherwise supplying a carrier fiber configured to fit within the hollow interior of the tube, such as, for example, the carrier fiber 110 described above with reference to FIG. 1. For example, a yarn or string or polymeric material configured to carry a reactive material may be fabricated or otherwise provided. In various embodiments, the carrier fiber may be extruded using a similar process used to extrude the tube described above. More specifically, in various embodiments, an extrusion process may include melting the polymeric material at a temperature between 200° C. (392° F.) and 227° C. (441° F.) or oven processing the polymeric material at a temperature between 250° C. (482° F.) and 280° C. (536° F.). The polymeric material may be further processed by extrusion through a die. The extrusion may occur at a temperature between 250° C. (482° F.) and 280° C. (536° F.).

A third step 206 may include depositing the reactive material within or on a carrier fiber outer surface. In various embodiments, for example, where the carrier fiber is a yarn or a string, the carrier fiber may be soaked in a solvent having the reactive material dispersed throughout the solvent. In various embodiments, for example, where the carrier fiber is a polymeric material, the reactive material may be applied to the carrier fiber outer surface following extrusion and prior to the carrier fiber having cooled. More specifically, in various embodiments, a reactive material comprising HNS, as described above, may be distributed on the carrier fiber outer surface as the carrier fiber exits an extrusion die. The ignition onset temperature of HNS, for example, is approximately 320° C. (608° F.), which is greater than the processing temperature of the extrusion process. Therefore, the carrier fiber comprising, for example, poly ethylene chlorotrifluoroethylene, may be coated with the reactive material, e.g., at a location downstream of the exit of the extrusion die, at a lower temperature than the ignition temperature of the reactive material. In a fourth step 208, the carrier fiber, saturated or coated with reactive material, may be threaded or otherwise inserted through the tube to provide the explosive cord.

In various embodiments, the disclosure above described facilitates installation of an energetic-coated or laden carrier fiber, porous or non-porous, synthetic or natural, having a smaller outer diameter than an inner diameter of a surrounding plastic tube. The carrier fiber may be saturated or coated with an energetic or reactive material before being installed in the hollow tube core so that it may act as a robust scaffold. In various embodiments, the energetic material may be deposited on the fiber using evaporation of a carrier solvent. In various embodiments, the energetic may be co-deposited with a glue or binder to facilitate adhesion to the carrier fiber or it may be sprayed on or itself extruded within the carrier fiber. The extruded surrounding tube may also be cooled well below its melting point prior to installation of the fiber. The disclosure enables precise quantification by weight of the deposited energetic material when using non-transparent extruded plastics or other materials of the carrier fiber. Further, the disclosure enables cooling of the outer tube before filling the tube with the energetic-coated or laden carrier fiber, which further enables use of energetic fills having thermal decomposition points well below the extrusion temperature of the carrier fiber or the surrounding tube. The carrier fiber may therefore retain the energetic material so loose powder loads do not accumulate or migrate during the extrusion process. Further, the energetic material formulation in the tube may be readily changed or modified for rapid prototyping.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed:

1. An explosive cord, comprising:

a tube having a tube inner surface and a tube outer surface, the tube inner surface defining a hollow interior that extends along a length of the tube;

a carrier fiber disposed within the hollow interior of the tube, the carrier fiber having a carrier fiber exposed surface area;

a reactive material disposed on the carrier fiber exposed surface area; and a hollow space extending along the length of the tube between the tube inner surface and the reactive material such that the reactive material is exposed to the hollow space.

2. The explosive cord of claim 1, wherein the reactive material comprises an organic explosive component.

3. The explosive cord of claim 2, wherein the reactive material comprises between seventy percent and one-hundred percent by weight of the organic explosive component.

4. The explosive cord of claim 3, wherein the reactive material includes a metallic component.

5. The explosive cord of claim 4, wherein the reactive material comprises up to thirty percent by weight of the metallic component.

6. The explosive cord of claim 5, further comprising an outer shell disposed about the tube outer surface.

7. The explosive cord of claim 1, wherein the carrier fiber comprises a polymeric material.

8. The explosive cord of claim 7, wherein the polymeric material comprises a poly ethylene chlorotrifluoroethylene component.

9. The explosive cord of claim 8, wherein the reactive material is adhered to the carrier fiber exposed surface area by a binder.

10. The explosive cord of claim 9, wherein the reactive material includes particles of an organic explosive disposed on the carrier fiber exposed surface area.

11. The explosive cord of claim 10, wherein the particles of the organic explosive have a size between about twelve microns and about thirty microns.

12. The explosive cord of claim 1, wherein the carrier fiber comprises a porous material.

13. The explosive cord of claim 12, wherein the reactive material is disposed within the carrier fiber using a solvent laden with the reactive material.

14. The explosive cord of claim 13 wherein the carrier fiber is a string or a yarn.

* * * * *